US008590472B2

(12) United States Patent
Biaggi et al.

(10) Patent No.: US 8,590,472 B2
(45) Date of Patent: Nov. 26, 2013

(54) INSTALLATION FOR TRANSFERRING A FLUID BETWEEN A TANKER AND A FIXED STRUCTURE

(75) Inventors: Jean-Pascal Biaggi, La Celle Saint Cloud (FR); Virginie Lehning, Boulogne Billancourt (FR)

(73) Assignee: Technip France (FR)

( * ) Notice: Subject to any disclaimer, the term of this patent is extended or adjusted under 35 U.S.C. 154(b) by 387 days.

(21) Appl. No.: 12/677,870

(22) PCT Filed: Sep. 5, 2008

(86) PCT No.: PCT/FR2008/051586

§ 371 (c)(1), (2), (4) Date: May 11, 2010

(87) PCT Pub. No.: WO2009/044052

PCT Pub. Date: Apr. 9, 2009

(65) Prior Publication Data

US 2010/0300545 A1 Dec. 2, 2010

(30) Foreign Application Priority Data

Sep. 12, 2007 (FR) ..... 07 57527

(51) Int. Cl.

*B63B 22/02* (2006.01)
*B63B 27/24* (2006.01)
*B63B 35/44* (2006.01)

(52) U.S. Cl.

USPC ..... 114/230.1; 114/230.2; 114/264; 441/4

(58) Field of Classification Search

USPC ..... 441/3–5; 114/230.1, 230.12–230.2, 114/264, 265; 414/137.1, 137.5, 414/137.9–138.2; 141/279, 387, 388; 137/615; 62/50.1–50.7, 53.2, 611–614

See application file for complete search history.

(56) References Cited

U.S. PATENT DOCUMENTS 3,154,118 A * 10/1964 Silveston ..... 141/388
3,354,479 A * 11/1967 Dickson et al. ..... 441/5
3,366,088 A * 1/1968 Gibson ..... 114/230.1
3,541,622 A * 11/1970 Harlow ..... 441/5
3,621,662 A 11/1971 Starr et al.

(Continued)

FOREIGN PATENT DOCUMENTS

WO WO 98/46478 A 10/1998

OTHER PUBLICATIONS

International Search Report dated Sep. 23, 2009, issued in corresponding international application No. PCT/FR2008/051586.

*Primary Examiner* — Ajay Vasudeva
(74) *Attorney, Agent, or Firm* — Ostrolenk Faber LLP

(57) ABSTRACT

This installation comprises a transport conduit which is at least partially submerged in a body of water, a device for conveying fluid between the vessel and the conduit, and a floating platform for securing the vessel. The platform comprises a carrier structure which is partially submerged in the body of water. The carrier structure comprises an open-work trellis which delimits internal spaces which are for circulation of water and which open in the body of water. The floating platform further comprises flexible lines for anchoring the carrier structure to the bottom of the body of water. The ratio of the volume of the internal spaces to the total of the volume of the open-work trellis and the volume of the internal spaces is greater than 0.9.

17 Claims, 6 Drawing Sheets

(56) References Cited

U.S. PATENT DOCUMENTS

| | | | | | |
|---|---|---|---|---|---|
| 3,712,330 | A | | 1/1973 | Davis | |
| 3,765,463 | A | * | 10/1973 | Gassett et al. | 141/388 |
| 3,839,977 | A | | 10/1974 | Bradberry | |
| 4,261,398 | A | | 4/1981 | Haley | |
| 7,107,925 | B2 | * | 9/2006 | Wille et al. | 114/230.15 |
| 7,287,484 | B2 | * | 10/2007 | Landry et al. | 114/230.1 |
| 7,299,760 | B2 | * | 11/2007 | Boatman et al. | 114/230.12 |
| 7,673,577 | B2 | * | 3/2010 | Poldervaart et al. | 114/230.1 |
| 8,186,170 | B2 | * | 5/2012 | Boatman et al. | 62/50.2 |
| 2005/0145154 | A1 | | 7/2005 | De Baan | |

* cited by examiner

INSTALLATION FOR TRANSFERRING A FLUID BETWEEN A TANKER AND A FIXED STRUCTURE

CROSS REFERENCE TO RELATED APPLICATIONS

The present application is a 35 U.S.C. §371 National Phase conversion of PCT/FR2008/051586, filed Sep. 5, 2008, which claims benefit of French Application No. 0757527, filed Sep. 12, 2007, the disclosure of which is incorporated herein by reference. The PCT International Application was published in the French language.

BACKGROUND OF THE INVENTION

The present invention relates to an installation for transferring a fluid between a transport vessel and a fluid reservoir on a fixed structure, of the type comprising:

- a conduit which is for transporting the fluid towards the fixed structure and which is at least partially submerged in a body of water;
- a device which is for conveying fluid between the vessel and the transport conduit and which is connected to a connection end of the transport conduit; and
- a floating platform which is for securing the vessel and which is positioned beside the connection end and which is locally movable in the body of water, the floating platform comprising:
  - a carrier structure which is intended to be partially submerged in the body of water, the carrier structure comprising an open-work trellis which delimits internal spaces which are for circulation of water and which are intended to open in the body of water,
  - flexible lines for anchoring the structure to the bottom of the body of water;
  - means for fixing lines for securing the vessel to the carrier structure.

The present invention is used particularly for transferring liquid hydrocarbons, such as liquefied gases, such as liquefied natural gas (LNG) or liquefied petroleum gas (LPG) between a transport vessel and a fixed structure. That fixed structure is, for example, a liquefaction unit or a gasification terminal during the charging of the vessel or a fluid reservoir during discharge thereof.

Taking into account some constraints, concerning safety and movement of the vessels, it is preferable to carry out the operations for transferring fluid with the vessel being kept outside a port, in relatively deep waters, for example, several hundreds of meters away from the coast.

In order to carry out such operations on the open sea, there are known in particular stations for charging or discharging vessels comprising a platform for transferring fluid that is fixed to the sea bed by a fixing structure which is positioned on the sea bed and which is referred to as a "jacket". The platform supports articulated fluid transfer arms which are intended to be connected to traverse systems of the vessel which are referred to as "manifolds" on the vessel.

The known charging stations further comprise an assembly of "dolphins" in order to absorb the docking energy of the vessel and to secure it after its docking. The dolphins are also fixed to the sea bed by rigid metal piles.

The fluid transfer platform is connected to a reservoir located on the coast or on a fixed platform at sea via a flexible conduit or a pipeline which is partially or completely submerged.

This type of transfer station requires a sufficient depth of water for the draught of the vessel. Nevertheless, when the vessel is secured to the dolphins, it is not free to become orientated with respect to the elements. Without adequate protection against the swell which is generally ensured by a barrage, the relative movements between the vessel and the charging station are further very substantial. The forces applied to the securing lines between the vessel and the dolphins are therefore great, which means that the transfer station must be positioned in a sheltered site.

In order to overcome this problem, US 2004/0216485 describes a transfer installation of the above-mentioned type, in which the dolphins are replaced by semi-submersible open-work assemblies which are anchored to the sea bed by means of flexible anchoring lines.

The semi-submersible assemblies are positioned remote from the charging platform at one side and the other thereof in order to secure the front and the rear of the vessel, respectively. Those carrier structures are massive because they comprise pillars having a diameter of approximately 10 meters and struts having a contact surface-area with the water which is very large in relation to the overall volume of the structure.

In this manner, the carrier structures have substantial inertia, when they are connected to the vessel by the securing lines, so that the assembly constituted by the structure and the vessel absorbs the swell in calm weather.

However, such an installation is not entirely satisfactory. Since the carrier structure is dynamically heavy, it may have significant inertia in relation to the inertia of the vessel which is secured thereto, taking into consideration the high mass of the water which loads it and the high contact surface-area with respect to the body of water in which it is floating. The high constraints therefore continue to be applied to the securing lines between the vessel and the carrier structures.

Although the carrier structures further allow the swell to be absorbed in calm weather owing to their weight, they still remain very sensitive, owing to the large contact surface-area thereof with the water, to waves or the swell over the body of water under very poor weather conditions, in particular when the swell is greater than six meters. Consequently, the securing lines of the carrier structures must be over-dimensioned in order to withstand the swell in the case of rough weather.

SUMMARY OF THE INVENTION

An object of the invention is to provide a transfer installation which can readily be used remote from the coast with the dynamic forces owing to docking and the securing constraints between the vessel and the carrier structure being limited and which can nevertheless withstand waves of very great height under extreme conditions.

To that end, the invention relates to a transfer installation of the above-mentioned type, characterised in that the ratio of the volume of the internal spaces to the total of the volume of the open-work trellis and the volume of the internal spaces is greater than 0.9.

The installation according to the invention may comprise one or more of the following features taken in isolation or in accordance with any technically possible combination:

- the conveying device comprises a fluid transfer assembly which is mounted on the open-work trellis, the transfer assembly comprising at least one flexible upstream fluid transfer conduit which is intended to be connected to the vessel;
- the installation comprises a fixed support platform which comprises at least one pillar which is fixed to the bottom of the body of water, the conveying device comprising an assembly which is for connection to the transport conduit and which is carried by the support platform, the connection end of the transport conduit being connected to the connection assembly on the support platform;

the transfer assembly comprises at least one flexible downstream fluid transfer conduit which is intended to be connected to the connection assembly on the support platform;

the support platform and the carrier structure together delimit an intermediate space, the or each flexible downstream conduit being provided with emergency disconnection means which extend opposite the intermediate space;

the carrier structure has a shape which is elongate along an axis delimiting a lateral surface for docking the vessel and an opposite lateral surface, the lateral surfaces extending between two ends of the carrier structure, the support platform being positioned opposite the opposing surface between those ends or in axial continuation of the carrier structure opposite one of the ends;

the conveying device comprises an assembly for connection to the transport conduit carried by the carrier structure, the connection end of the transport conduit being connected to the connection assembly on the carrier structure;

the or each flexible upstream conduit is capable of at least partially projecting away from the carrier structure towards the vessel, the or each flexible upstream conduit being provided with emergency disconnection means;

the ratio of the volume of the internal spaces to the total of the volume of the open-work trellis and the volume of the internal spaces is between 0.95 and 0.99;

the open-work trellis comprises a plurality of tubular beams which are connected to each other, the perimeter of the carrier structure when viewed in projection in a horizontal plane being greater than at least fifty times the maximum diameter of the beams.

The invention further relates to an assembly for transporting a fluid comprising:

a transport vessel of the fluid; and an installation as defined above, the vessel being secured to the floating platform by means of securing lines which are fixed to the fixing means of the securing lines so that the vessel moves vertically together with the floating platform.

The transport assembly may comprise one or more of the following features taken in isolation or in accordance with any technically possible combination:

the weight of the carrier structure is less than 5% of the weight of the vessel; and the installation comprises a single floating platform for securing the vessel, the vessel being secured only to the single securing floating platform.

The invention also relates to a method for transferring a fluid in a transport assembly as defined above, characterised in that it comprises the following steps:

moving the vessel towards the floating platform in order to dock it opposite a docking surface of the carrier structure;

positioning securing lines in order to fixedly join the vessel and the carrier structure, the carrier structure being movable vertically together with the vessel;

hydraulic connection between a fluid reservoir which is carried by the vessel and the connection end of the transport conduit by means of the conveying device across or above the floating platform; and transferring fluid between the vessel and the transport conduit of the fluid.

The invention will be better understood from a reading of the following description which is given purely by way of example and with reference to the appended drawings, in which:

DESCRIPTION OF PREFERRED EMBODIMENTS

Figure 1:
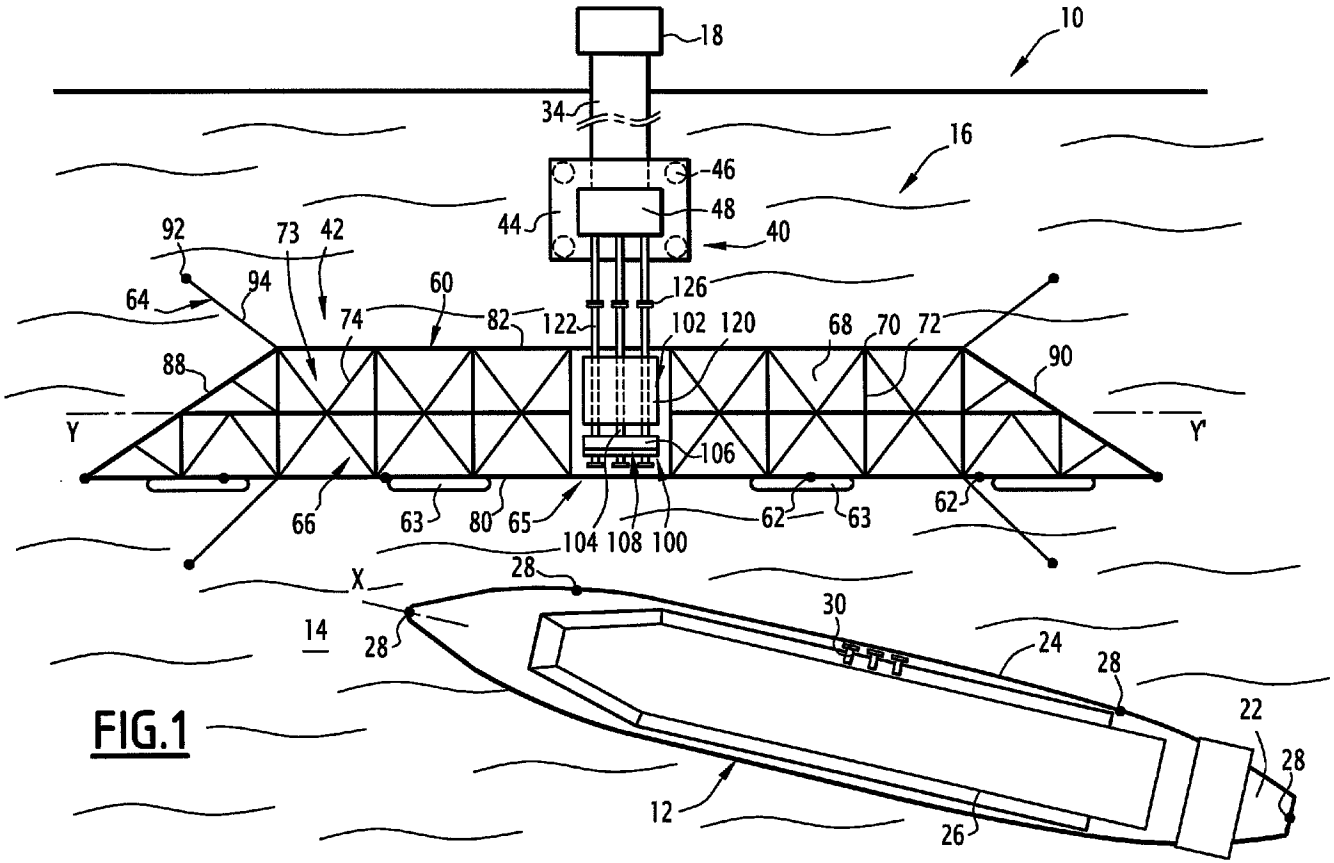
FIG. 1 is a schematic top view of a first transfer installation according to the invention, before the docking of a hydrocarbon transport vessel.

Hereinafter, the terms "longitudinal" and "transverse" are intended to be understood in relation to the elongate direction of a vessel or a carrier structure. The terms "upstream" and "downstream" are intended to be understood in relation to the direction of movement of a fluid during the discharge of this fluid from the vessel towards the transfer installation.

FIGS. 1 to 4, illustrate a first assembly 10 for transporting liquid hydrocarbons according to the invention.

The assembly 10 is used for the transport and transfer of liquefied hydrocarbons, in particular liquefied gas, such as liquefied natural gas (LNG), liquefied petroleum gas (LPG) or any other type of liquefied gas.

The transport assembly comprises a transport vessel 12 which floats on a body of water 14, a fluid transfer installation 16 which is provided in the body of water 14 in order to receive the vessel 12 and a fixed structure or terminal 18 located on the coast remote from the transfer installation 16 in order to receive the fluid discharged by the transfer installation 16 or to produce or store the fluid which is intended to be charged on the vessel 12 by the transfer installation 16.

Hereinafter, it will readily be understood that the transport assembly 10 is completely reversible, that is to say that the transfer installation 16 can be used either to charge the vessel 12 with a fluid stored or produced in the terminal 18 or, conversely, to discharge a fluid contained in the vessel 12 to convey it towards the terminal 18. Only the latter case will be described below by way of example.

The body of water 14 is a body of salt water, such as a sea or an ocean, or a body of freshwater, such as a lake.

The body of water rests on a solid base 20. The installation 16 is advantageously mounted in a body of water 14 having a depth of between 25 meters and 70 meters, although greater depths in particular up to 150 meters may be envisaged.

The transport vessel 12 comprises a floating hull 22 which delimits a lateral securing edge 24 and at least one storage reservoir 26 for liquefied fluid provided in the hull 22.

The vessel 12 further comprises, along the securing edge 24 thereof, securing lines 28 which are fixed to the front, rear and central portion of the vessel 12, respectively. Those lines comprise in particular a location at the front of the vessel 12, a location at the rear of the vessel 12 and traversing lines in the central portion of the vessel.

The reservoir 26 comprises a plurality of manifolds 30 which open transversely relative to the vessel 12, substantially in the central portion of the vessel 12.

Each manifold 30 is provided at the outer end thereof with a connection flange and, advantageously, a removable connector 32 which is capable of projecting beyond the lateral edge 24 in order to connect a fluid transfer line. Such connectors are described, for example, in French application numbers 0605434 and 0754438 by the same applicant.

The terminal 18 is arranged, for example, on the coast or at sea, remote from the transfer installation 16. The terminal 18 comprises storage reservoirs for liquefied hydrocarbons. Those reservoirs are located, for example, at the outlet of a works for producing liquefied hydrocarbons provided with a liquefaction line when the transfer installation 16 is used to charge fluid in the vessel 12.

The terminal 18 is connected to the transfer installation 16 by means of a cryogenic conduit 34 which is submerged in the body of water 14 and which is connected to at least one fluid reservoir of the terminal 18. The conduit 34 is, for example, of the "Pipe-in-Pipe" type marketed by the company Flexi France under the commercial name C-PIP (Cryogenic Pipe in Pipe). The distance which separates the installation 16 from the terminal 18 is greater than 100 meters and is generally between 500 meters and 1500 meters.

The transfer installation 16 comprises a fixed platform 40 for connecting the cryogenic conduit 34 and a floating platform 42 for receiving and securing the vessel 12 to the installation 16.

Figure 3:
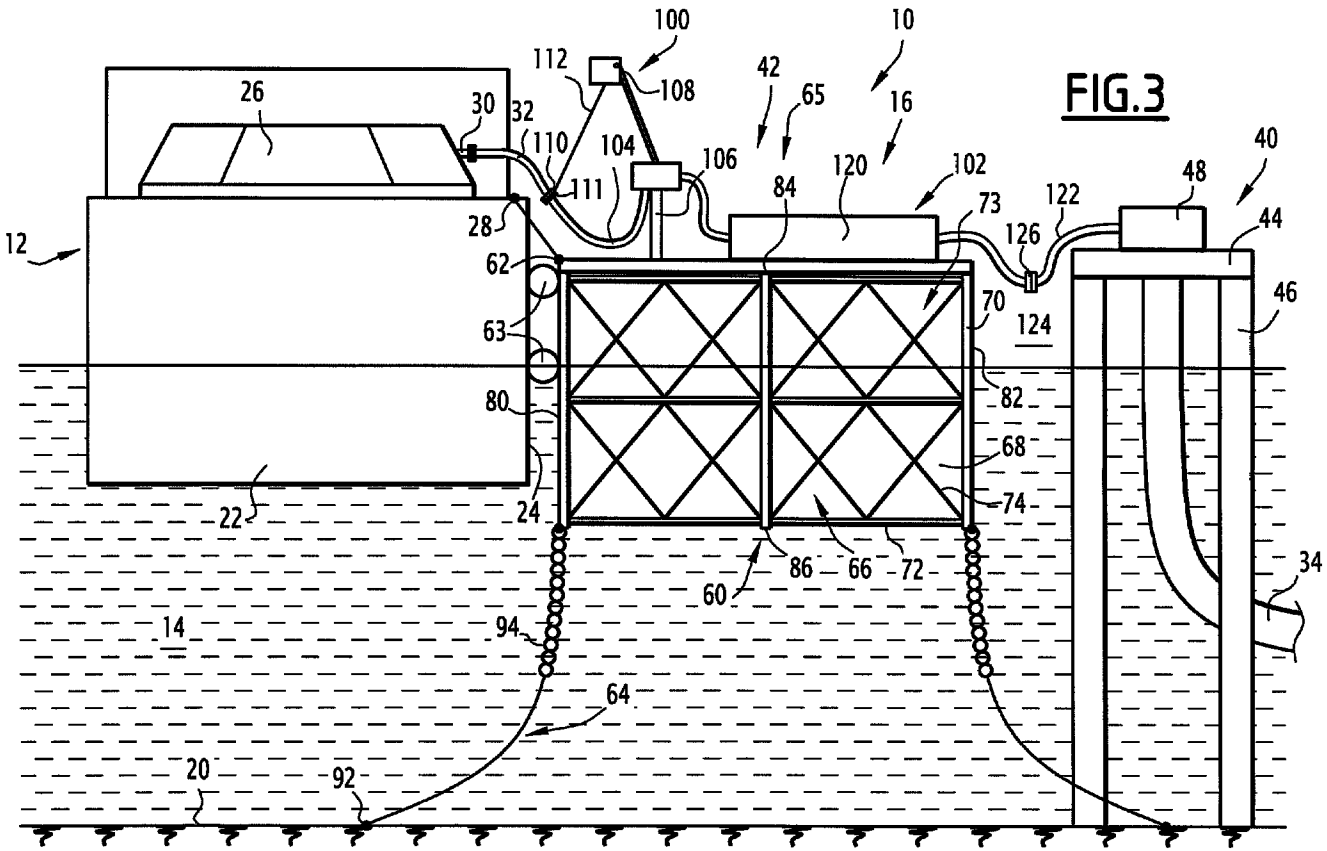
FIG. 3 is a sectional view taken in a transverse plane of the installation of FIG. 2 during a transfer of hydrocarbons between the installation and the vessel.

As illustrated in FIG. 3, the platform 40 comprises a support 44 which is located above the surface of the body of water 14, pillars 46 for fixing the support 44 to the bottom of the body of water 14 and an assembly 48 for connection to the cryogenic conduit 34 carried by the support 44.

The pillars 46 are constructed, for example, in the form of parallel members which are connected to each other by a trellis of metal beams or are constructed by tubular vessels. They are fixed at the lower edge thereof to the bottom 20 of the body of water on which they are supported and, at the upper edge thereof, below the support 44. In this manner, the platform 40 remains substantially fixed in position vertically, whatever the conditions of agitation of the body of water 14.

The connection assembly 48 receives an upstream end of the cryogenic conduit 34.

Figure 2:
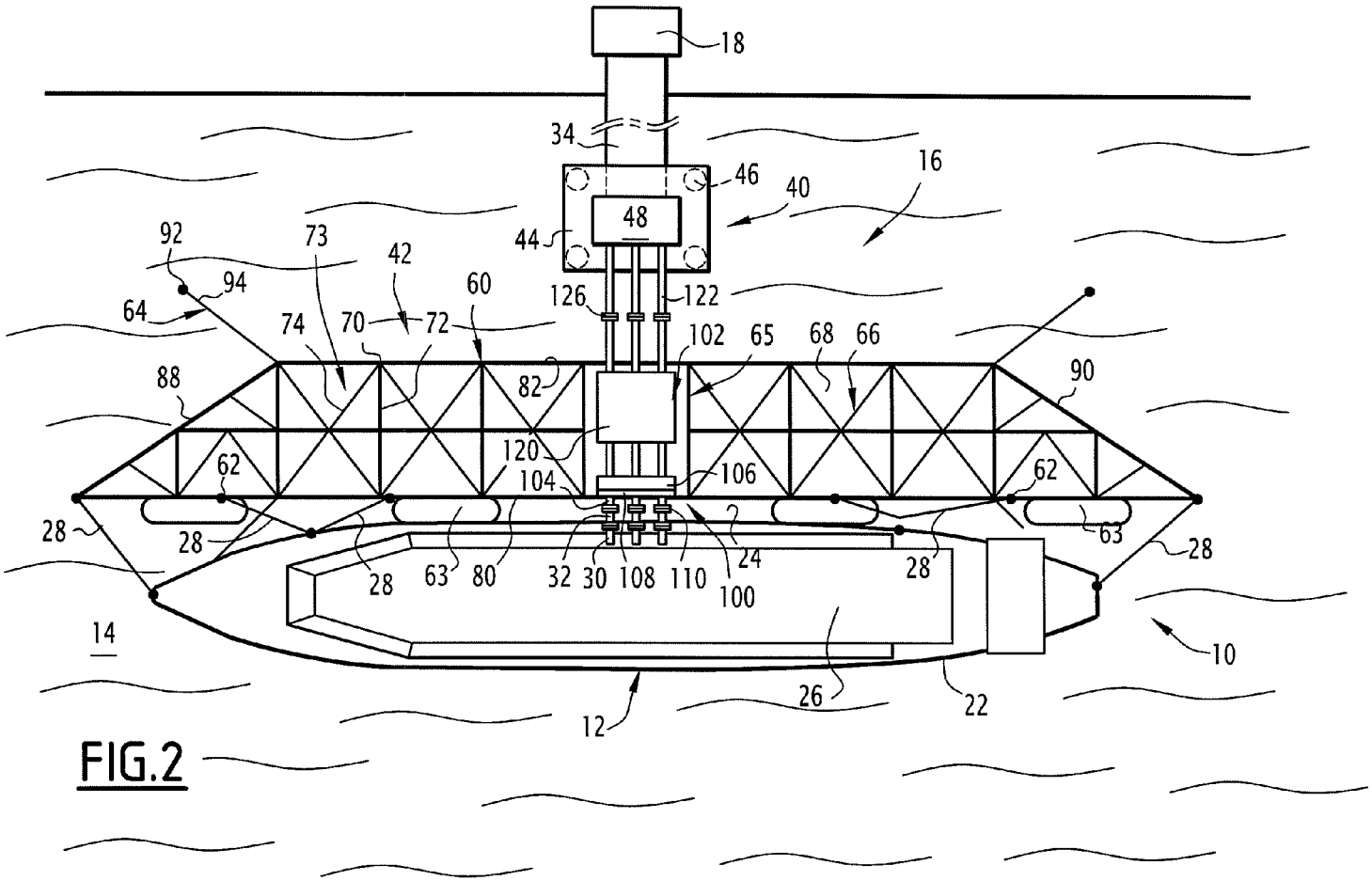
FIG. 2 is a view similar to FIG. 1 after the docking of the vessel.

As illustrated by FIGS. 1 to 3, the floating platform 42 comprises an open-work carrier structure 60, studs 62 for fixing the securing means 28 to the structure 60, docking defences 63 and flexible lines 64 for anchoring the carrier structure 60 on the bottom 20 of the body of water 14.

The transfer installation 16 further comprises an assembly 65 for transferring fluid between the vessel 12 and the connection assembly 48 and which is intended to hydraulically connect the manifolds 30 of the reservoir 14 to the connection assembly 48.

According to the invention, the carrier structure 60 comprises a light open-work trellis 66 which delimits internal spaces 68 for the circulation of large volumes of water so that the carrier structure 60 is substantially transparent in relation to agitation of the body of water 14 and in particular the swell.

As illustrated in FIGS. 1 and 2, the structure 60 and the trellis 66 thereof are of elongate shape along an axis Y-Y' which is substantially parallel with the longitudinal axis X-X' of the vessel 12 when the vessel 12 is secured to the platform 42.

In the example illustrated in FIGS. 1 to 3, the trellis 66 has a horizontal section which is substantially constant over the entire height thereof. The horizontal section has a polygonal contour. The height of the trellis 66 is further substantially constant.

The trellis 66 comprises a plurality of vertical beams 70, a plurality of horizontal struts 72 which connect the beams 70 in order to define parallelepipedal elementary mesh 73 and a plurality of oblique cross-members 74 which each connect a beam 70 to a strut 72 via a mesh 73.

The beams 70, the struts 72 and the cross-members 74 are all constructed on the basis of hollow metal tubes which are assembled together. Those tubes have a small maximum diameter so that the perimeter of the carrier structure 60, when viewed in projection in a horizontal plane, is greater than at least 50 times the maximum diameter of the tubes forming the beams 70, the struts 72 and the cross-members 74. The recesses delimited within the hollow tubes are separated from the water circulation spaces 68 by the fluid-tight walls forming the tubes.

In this manner, the carrier structure 60 floats spontaneously with spacing from the bottom when it is submerged in the body of water 14, having at least an upper region having a non-zero height projecting above the surface of the body of water 14.

The beams 70 have a diameter which is greater than that of the cross-members 74, which cross-members 74 have a diameter greater than that of the struts 72.

The beams 70 are distributed over the contour of the carrier structure 60 and along the centre axis Y-Y' inside the carrier structure 60. The diameter of the beams 70 is in the order of 2 m (approximately 80 inches) and is between 1 m and 4 m and the height thereof which defines the constant height of the structure 60 is in the order of 24 m and is between 15 m and 30 m.

The struts 72 connect the beams 70 perpendicularly to the axis of the structure 60. They have a diameter in the order of 0.6 m (24 inches) and between 0.3 m and 0.9 m.

The cross-members 74 have a diameter between 0.6 m and 0.9 m (between 30 and 50 inches).

In this manner, the weight of the structure is generally in the order of 3200 tonnes so as to be less than 5% of the maximum weight of the vessel 12.

The trellis 66 of the structure 60 therefore defines, in accordance with the outer envelope thereof, a vertical upstream surface 80 for docking the vessel, a vertical downstream surface 82, opposite the upstream surface 80 and extending facing the platform 40, an upper horizontal surface 84 for supporting the transfer assembly 65 and a lower surface 86 extending facing the bottom 20 of the body of water and with spacing from the bottom 20.

The platform 40 extends opposite a central portion of the opposing surface 82 with spacing therefrom. The distance which separates the surface 82 from the platform 40 is between 15 m and 30 m.

The structure 60 further defines two vertical end surfaces 88, 90 which are substantially transverse and which connect the upstream and downstream surfaces 80, 82 to the longitudinal ends of the carrier structure 60.

Therefore, the structure 60 defines, inside the envelope between the surfaces 80 to 90, a total volume which is the total of the volume of the tubes forming the trellis 60 and the volume of the internal spaces 68 which are delimited between the tubes.

The internal spaces 68 are defined between the tubes forming the trellis 66. They open outside the carrier structure 60 via the surfaces 80 to 90 so as to allow circulation of water through the structure 60, making the structure 60 transparent in relation to the swell.

According to the invention, and in order to ensure that transparency relative to the swell, the ratio of the volume occupied by the internal spaces 68 to the total of the volume of the internal spaces 68 and the volume occupied by the tubes forming the trellis 66 is greater than 0.9. Preferably, that ratio is between 0.95 and 0.99.

In this manner, the carrier structure 60 is open-work to a high degree so that it provides locally, at all locations of the structure 60, a small surface-area in contact with the water per unit of volume and a large space for circulation of water through the structure.

When the structure 60 is arranged in the body of water 14, it floats in the body of water 14 and is submerged therein substantially at a mid-point in terms of depth. The upper surface 84 is therefore arranged above the surface of the body of water.

The fixing studs 62 of the securing lines 28 are arranged on the upper surface 84 along the vertical docking surface 80. They are distributed at the front, rear and centre of the structure 60.

The anchoring lines 64 are distributed around the structure 60 in order to limit the movement thereof in a horizontal plane. In the example illustrated in FIG. 1, the floating platform 42 comprises two pairs of anchoring lines 64 which extend towards the exterior of the structure 60 in opposing axial directions, each pair extending from the vertical docking surface 80 and the opposing vertical surface 82, respectively.

Each line 64 comprises an anchoring means 92 which is fixed to the bottom 20 of the body of water 14 and a mixed line 94 which connects the anchoring means 92 to a tube of the trellis 66.

The mixed line 94 comprises a combination of a chain and a cable forming a catenary. The mixed line 94 has, in the rest state, a relaxed J-like shape. It is capable of becoming linearly tensioned during a movement of the carrier structure 60, in particular when the vessel is docked along the surface 80.

In this manner, the carrier structure 60 is locally movable horizontally over a limited path around a central rest position. That path is, for example, between 15 m and 30 m from the perimeter of the structure 60 in the rest position thereof.

The defences 63 are fixed to the trellis 66 along the vertical docking surface 80. They are intended to be interposed between the lateral edge 24 of the vessel 12 and the carrier structure 60 when the vessel is secured to the structure 60.

In the example illustrated in FIG. 3, the structure 60 comprises two parallel rows of defences 63 positioned at different heights over the surface 80.

In a variant, the structure 60 comprises, for example, a first row of horizontal defences 63 and a second row of vertical defences 63.

The fluid transfer assembly 65 is mounted on the upper surface 84 of the carrier structure 60. It comprises, in a downstream direction, a station 100 for connection to the vessel located beside the docking surface 80 and a station 102 for connection to the platform located beside the opposing surface 82.

The station 100 for connection to the vessel comprises flexible upstream conduits 104 for connection to the vessel, a fixed frame 106 for supporting the conduits 104 and a movable frame 108 for moving the conduits 104 towards the vessel 12.

In conventional manner, the conduits 104 are formed by flexible transport means which are flexible over substantially the entire length thereof. Each conduit 104 extends between a fixed end which is fixedly joined to the fixed frame 108 and a movable free end 110 which is provided with an end-piece for connection to a connector 32, and an emergency disconnection valve 111.

The flexible upstream conduits 104 are hydraulically connected to the connection station 102 via the fixed frame 106.

The movable frame 108 can be moved relative to the fixed frame 106 towards the exterior of the vessel between a retracted position on the upper surface 84 and a lateral projecting position at the outer side of the upper surface 84.

The frame 108 is provided, for each conduit 104, with a winch 112 in order to suspend the free end 110 of the flexible conduit 104.

The conduit 104 extends in a chain-like manner between its fixed end and its free end 110 in a vertical plane which is substantially perpendicular to the axis Y-Y'. The conduit 104 can thereby be moved in that plane between a recessed position, in which the free end 110 extends opposite the upper surface 84 and a position for connection to the vessel 12, in which the free end 110 projects away from the surface 84 beyond the surface 80 facing the body of water 14.

The station 102 comprises a collector 120 which is fixed to the upper surface 84 and flexible downstream conduits 122 which connect the collector 120 to the connection assembly 48 on the platform 40.

The collector 120 is hydraulically connected upstream to the flexible upstream conduits 104 and, downstream, to the flexible downstream conduits 122.

The flexible downstream conduits 122 are flexible over substantially the entire length thereof. They are suspended in a chain-like manner between the connection assembly 48 and the collector 120, opposite the intermediate space 124 which is open in a downward direction, extending above the body of water 14 between the floating platform 42 and the fixed platform 40. They extend in a vertical plane substantially perpendicular to the axis Y-Y', substantially in continuation of the flexible upstream conduits 104.

Each conduit 122 is provided with an emergency disconnection device 126 which is provided opposite the space 124 in order to separate the conduit 122 into an upstream section which is fixedly joined to the platform 42 and which is free in relation to the platform 40 and a downstream section which is fixedly joined to the platform 40 and which is free in relation to the platform 42.

The transfer assembly 65 which is located on the carrier structure 60 and the connection assembly 48 which is located on the fixed platform therefore form, when they are connected to each other, a device for conveying fluid between the vessel 12 and the transport conduit 34.

The operation of the transport assembly 10 according to the invention will now be described, during an operation for discharging the fluid contained in a transport vessel 12 for its transfer into a reservoir of the terminal 18.

Initially, when the vessel 12 is not present or as it approaches, the floating platform 42 is kept anchored to the bottom 20 of the body of water 14 by means of the anchoring lines 64. The fixed platform 40 extends facing the opposing vertical surface 82 of the carrier structure 60 substantially at the centre of that surface 82.

The flexible downstream conduits 122 hydraulically connect the connection station 102 on the carrier structure 60 to the connection assembly 48 on the platform 40.

The movable frame 108 is further positioned in its retracted position in order to maintain the free ends 110 of the flexible upstream conduits 104 opposite the upper surface 84.

Therefore, since the trellis 66 of the carrier structure 60 is light and open-work to a very great degree, it is not very sensitive to agitation of the body of water 14 at the surface or at depth resulting from the swell or currents. The water of the body 14 therefore circulates practically freely through the internal spaces 68.

Therefore, the floating platform 42 can withstand extremely difficult conditions, in particular a swell having a vertical extent greater than 6 meters.

Subsequently, when meteorological conditions required are encountered, for example, when the extent of the swell is less than 2.5 meters, the vessel 12 approaches the floating platform 42 in order to dock, as is visible in FIG. 1.

The lateral edge 24 of the vessel is moved opposite the vertical docking surface 80 with the axis X-X' of the vessel 12 being aligned parallel with the axis Y-Y' of the carrier structure 60.

Since the carrier structure 60 is anchored to the bottom 20 of the body of water by flexible lines 64, it is capable of moving slightly from its rest position towards the fixed platform 40 when the vessel is docking, owing to tension of the flexible lines 64 which are fixed to the docking surface 80. This allows the vessel 12 to dock with a speed of between 0.3 m/s and 1 m/s without causing damage to the transfer installation 16, whilst allowing damping of the docking impact.

When the edge of the vessel 24 is positioned parallel with the surface 80, in contact with the absorption defences 63, the securing lines 28 of the vessel are fixed to the fixing studs 62 of the floating platform 42. The flexible lines 64 take up the J-like configuration thereof, thereby moving the carrier structure 60 towards its rest position.

The vessel 12 is fixedly joined to the carrier structure 60 and moves together with it under the effect of agitation of the body of water.

However, since the carrier structure 60 has a negligible mass in relation to that of the vessel 12, and weak local interaction with the water circulating in the internal spaces 68, it has very weak inertia in relation to that of the vessel 12, which greatly limits the loads being applied to the securing lines 28 and the fixing studs 62.

In this configuration, the vessel 12 is retained so as to be substantially fixed in position relative to the platform 40 by means of the carrier structure 60 and the anchoring lines 64. The flexible anchoring lines 64 just take up the loads owing to the local movement of the vessel 12, the inertia of the carrier structure 60 being negligible. Therefore, the lines 64 do not need to be dimensioned for substantial loads.

Subsequently, the removable connectors 32 are fixed to the free end of the manifolds 30 in order to protrude beyond the lateral edge 24 of the vessel towards the carrier structure 60.

The movable frame 108 is subsequently moved from its retracted position to its deployed position in order to move the free end 110 of each flexible upstream conduit 104 into contact with a connector 32 in order to connect them.

A continuous passage for the circulation of fluid is therefore constructed. The passage extends in a downstream direction, successively in the manifold 30 and the connector 32, the flexible upstream conduit 104, the frame 106, the collector 120, the flexible downstream conduit 122, the connection assembly 48, then the cryogenic conduit 34.

The liquefied fluid contained in the reservoir 26 is discharged through that circulation passage from the vessel 12 via the transfer assembly 65 located on the floating platform 42, via the connection assembly 38 on the platform 40 and via the conduit 34 as far as the terminal 18.

In the event of problems during the transfer, the emergency disconnection valves 111 and 126 on the flexible upstream conduit 104 or on the flexible downstream conduit 122 can be disconnected, which prevents accidental discharge of the fluid on the vessel 12, floating platform 42 or platform 40.

Figure 4:
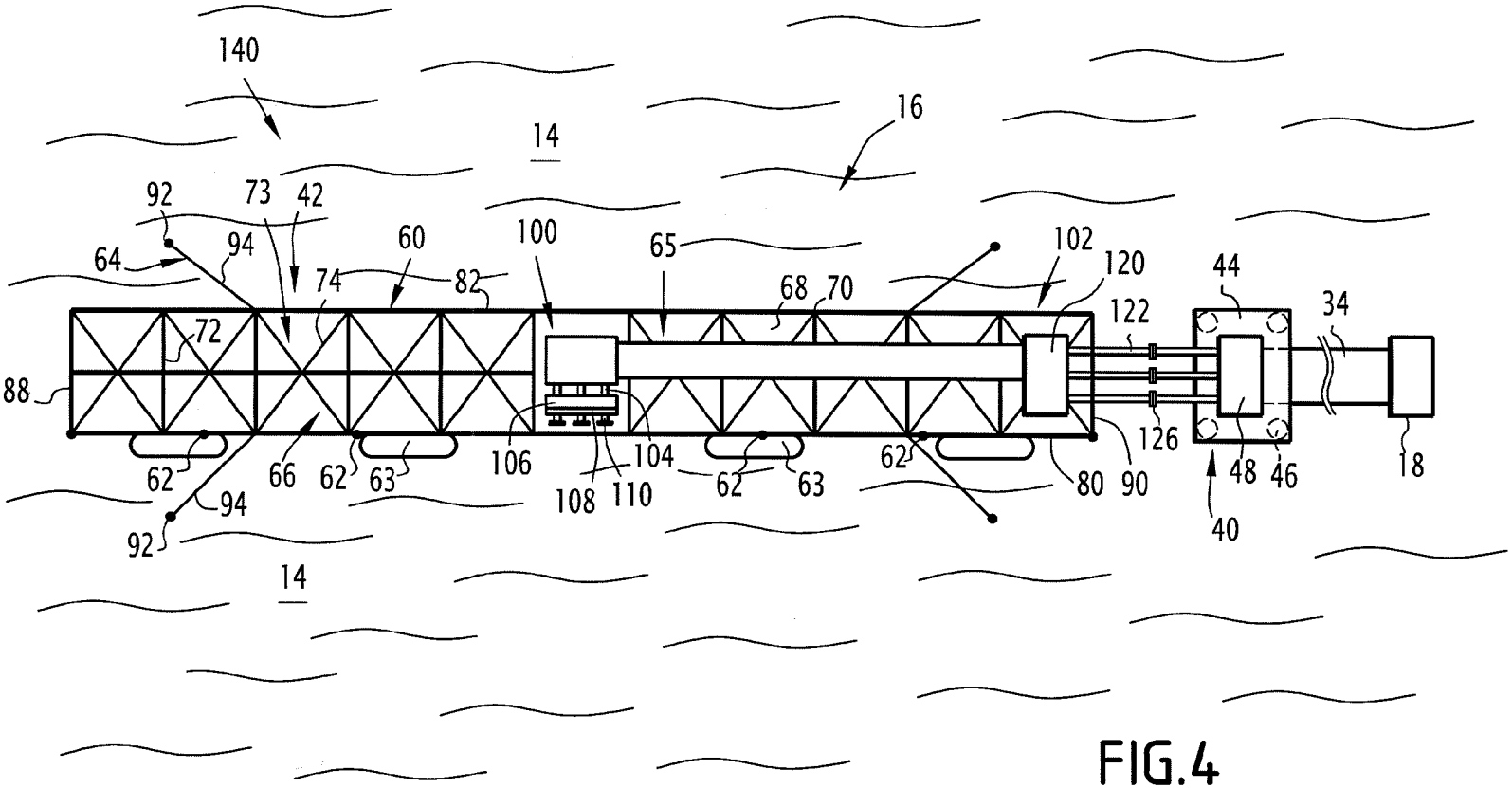
FIG. 4 is a view similar to FIG. 1 of a second transfer installation according to the invention.

The second transport assembly 140 according to the invention, which is illustrated in FIG. 4, differs from the first assembly 10 owing to the arrangement of the transfer installation 16.

The fixed platform 40 is positioned in axial continuation of the floating platform 42 opposite an end surface 90 of the platform.

Therefore, the flexible downstream conduits 122 are parallel with the axis Y-Y' of the platform 42 perpendicularly to the axis of the flexible upstream conduits 104.

The operation of the assembly 140 is further similar to that of the assembly 10.

Figure 5:
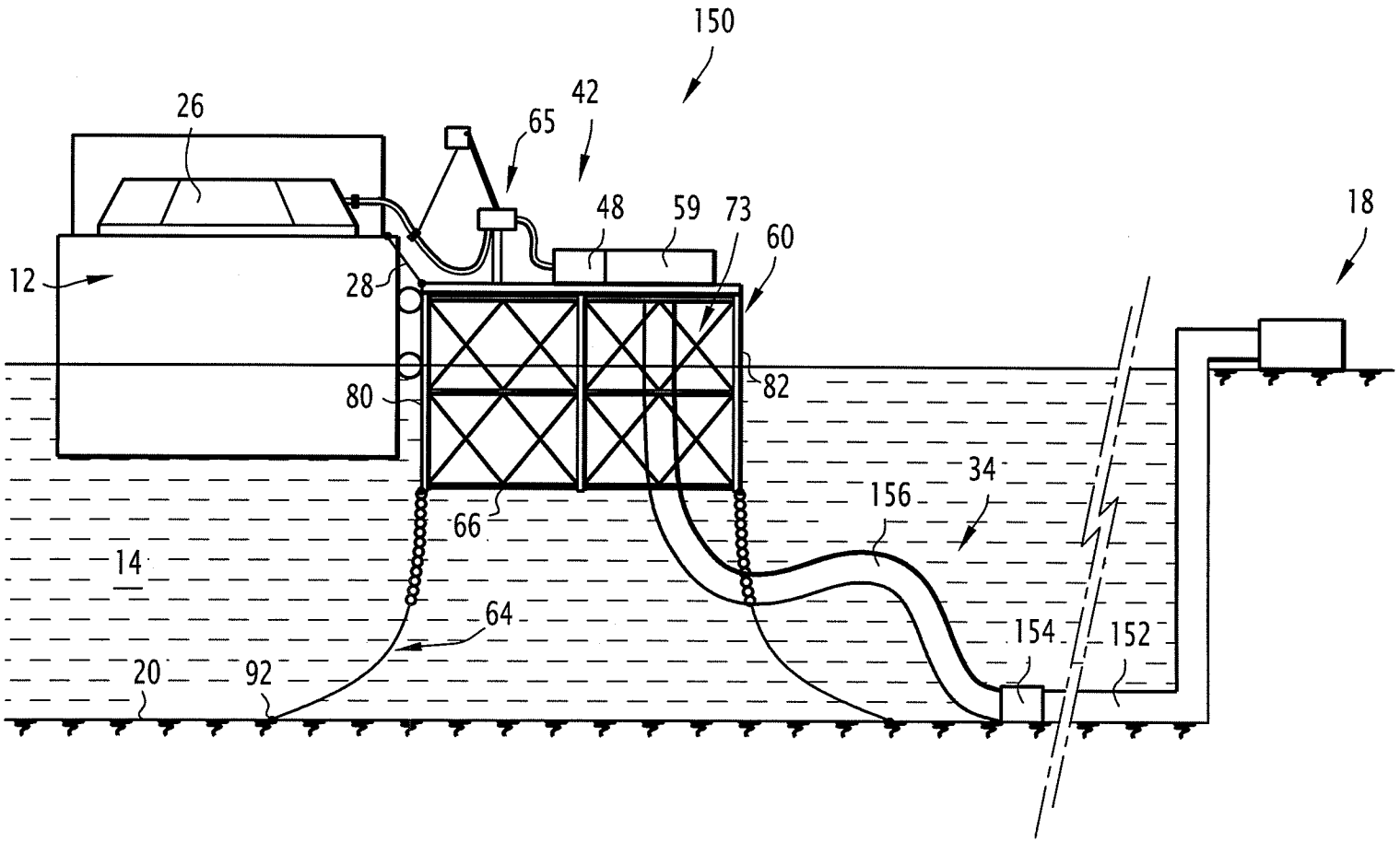
FIG. 5 is a view similar to FIG. 3 of a third transfer installation according to the invention.
Figure 6:
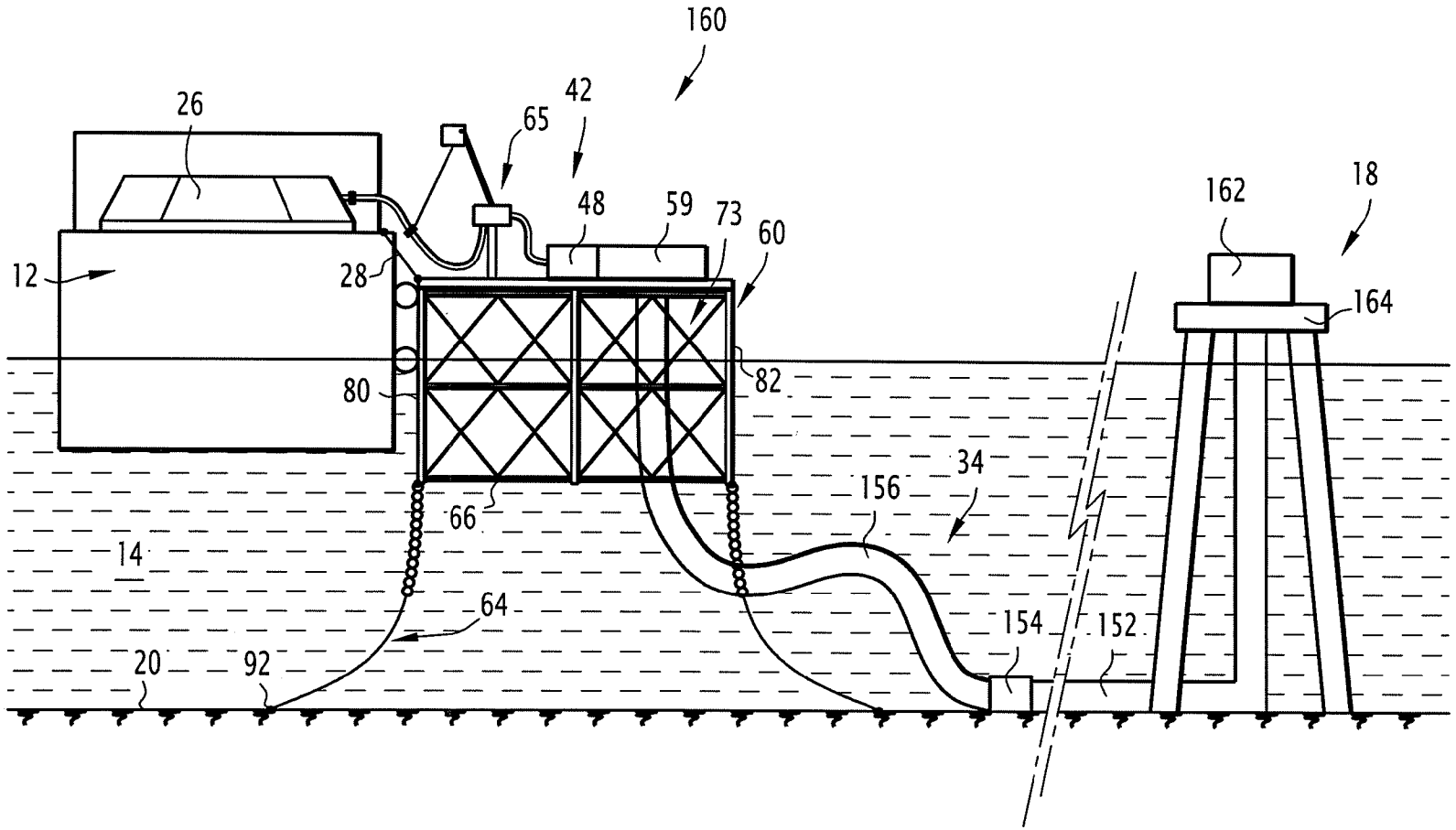
FIG. 6 is a view similar to FIG. 3 of a fourth installation according to the invention.

The third transport assembly 150 which is illustrated in FIG. 5 differs from the first assembly in that the transfer installation 16 does not have a fixed platform 40.

The transport conduit 34 comprises a substantially rigid submerged portion 152 and a flexible ascending portion 156.

The submerged portion 152 connects the terminal 18 to the coast at a location 154 at the bottom 20 located beside the carrier structure 60.

The flexible portion 156 is fixed to the structure 60 at the upstream connection end 59 thereof. It has an S-like configuration. The carrier structure 60 carries the connection assembly 48 which is connected to the connection end 59.

The fourth transport assembly 160 differs from the third assembly 150 in that the rigid portion 152 of the transport conduit 34 is connected to a reservoir 162 located on a platform 164 which is at sea and fixed to the sea bed by pillars 166.

More generally, the invention also relates to an installation for transferring a fluid between a transport vessel and a fluid reservoir on a fixed structure, of the type comprising:

- a conduit which is for transporting the fluid towards the fixed structure and which is at least partially submerged in a body of water;
- a device which is for conveying fluid between the vessel and the transport conduit and which is connected to a connection end of the transport conduit; and
- a floating platform for securing the vessel which is positioned beside the connection end and which is locally movable in the body of water, the floating platform comprising:
  - a carrier structure which is intended to be partially submerged in the body of water, the carrier structure comprising an open-work trellis which delimits internal spaces which are for circulation of water and which are intended to open in the body of water,
  - flexible lines for anchoring the structure to the bottom of the body of water;
  - means for fixing lines for securing the vessel to the carrier structure, the conveying device comprising a fluid transfer assembly which is mounted on the open-work trellis, the transfer assembly comprising at least one flexible upstream fluid transfer conduit which is intended to be connected to the vessel.

In that installation, the ratio of the volume of the internal spaces to the total of the volume of the open-work trellis and the volume of the internal spaces is not specified and may be less than 0.9.

What is claimed is:

1. Installation for transferring a fluid between a transport vessel and a fluid reservoir on a fixed structure, of the type comprising:

a transport conduit which is for transporting the fluid towards the fixed structure (18) and which is at least partially submerged in a body of water;

a conveying device which is for conveying fluid between the vessel and the transport conduit and which is connected to a connection end of the transport conduit; and a floating platform which is for securing the vessel and which is positioned beside the connection end and which is locally movable in the body of water, the floating platform comprising:

a carrier structure extending longitudinally between opposing ends, said carrier structure configured to be partially submerged in the body of water, the carrier structure comprising an open-work trellis which delimits internal spaces which are for circulation of water and which are intended to open in the body of water;

flexible lines connected proximate said opposing ends, wherein each flexible line is anchored at the bottom of the body of water;

means for fixing lines for securing the vessel to the carrier structure;

wherein the ratio of the volume of the internal spaces to the total of the volume of the open-work trellis and the volume of the internal spaces is greater than 0.9, wherein when the flexible lines are in a relaxed state the flexible lines are capable of being linearly tensioned and the carrier structure is at a rest position capable of movement, wherein when the carrier structure is moved from its rest position the flexible lines are linearly tensioned, and wherein the flexible lines return the carrier structure to the rest position when the flexible lines return to their relaxed state from their tensioned state.

2. Installation according to claim 1, wherein the conveying device comprises a fluid transfer assembly which is mounted on the open-work trellis, the transfer assembly comprising at least one flexible upstream fluid transfer conduit which is intended to be connected to the vessel.

3. Installation according to claim 2, wherein the conveying device comprises a connection assembly for connection to the transport conduit carried by the carrier structure, the connection end of the transport conduit being connected to the connection assembly on the carrier structure.

4. Installation according to claim 2, wherein the or each flexible upstream conduit is capable of at least partially projecting away from the carrier structure towards the vessel, the at least one flexible upstream conduit being provided with emergency disconnection means.

5. Installation according to claim 1, further comprising a fixed support platform which comprises at least one pillar which is fixed to the bottom of the body of water, the conveying device comprising a connection assembly which is for connection to the transport conduit and which is carried by the support platform, the connection end of the transport conduit being connected to the connection assembly on the support platform.

6. Installation according to claim 5, wherein the conveying device comprises a fluid transfer assembly which is mounted on the open-work trellis, the transfer assembly comprising at least one flexible upstream fluid transfer conduit which is intended to be connected to the vessel, and wherein the transfer assembly comprises at least one flexible downstream fluid transfer conduit which is intended to be connected to the connection assembly on the support platform.

7. Installation according to claim 6, wherein the support platform and the carrier structure together delimit an intermediate space, the at least one flexible downstream conduit being provided with emergency disconnection means which extend opposite the intermediate space.

8. Installation according to claim 5, wherein the carrier structure has a shape which is elongate along an axis delimiting a lateral surface for docking the vessel and an opposite lateral surface, the lateral surfaces extending between two ends of the carrier structure, the support platform being positioned opposite the opposing surface between the two ends or in axial continuation of the carrier structure opposite one of the ends.

9. Installation according to claim 1, wherein the ratio of the volume of the internal spaces to the total of the volume of the open-work trellis and the volume of the internal spaces is between 0.95 and 0.99.

10. Installation according to claim 1, wherein the open-work trellis comprises a plurality of tubular beams which are connected to each other, the perimeter of the carrier structure when viewed in projection in a horizontal plane being greater than at least fifty times the maximum diameter of the beams.

11. Installation according to claim 1, wherein the trellis has a horizontal section which is substantially constant over the entire height thereof.

12. Installation according to claim 1, wherein each flexible line forms a catenary in the rest position.

13. Installation according to claim 1, wherein the platform comprises at least two pairs of anchoring lines which extend toward the exterior of the structure in opposite axial directions.

14. Assembly for transporting a fluid wherein it comprises:

a transport vessel of the fluid; and the installation according to claim 1, the vessel being secured to the floating platform by means of securing lines which are fixed to the fixing means of the securing lines so that the vessel moves vertically together with the floating platform.

15. Assembly according to claim 14, wherein the weight of the carrier structure is less than 5% of the weight of the vessel.

16. Assembly according to claim 14, wherein the installation comprises a single floating platform for securing the vessel, the vessel being secured only to the single floating platform.

17. Method for transferring a fluid in a transport assembly according to claim 14, wherein it comprises the following steps:

moving the vessel towards the floating platform in order to dock it opposite a docking surface of the carrier structure;

positioning securing lines in order to fixedly join the vessel and the carrier structure, the carrier structure being movable vertically together with the vessel;

establishing hydraulic connection between a fluid reservoir which is carried by the vessel and the connection end of the transport conduit by means of the conveying device across or above the floating platform;

transferring fluid between the vessel and the transport conduit of the fluid.

* * * * *

UNITED STATES PATENT AND TRADEMARK OFFICE

CERTIFICATE OF CORRECTION

PATENT NO. : 8,590,472 B2
APPLICATION NO. : 12/677870
DATED : November 26, 2013
INVENTOR(S) : Biaggi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 567 days.

Signed and Sealed this
Twenty-second Day of September, 2015

Michelle K. Lee

Michelle K. Lee
*Director of the United States Patent and Trademark Office*